US005424702A

United States Patent [19]

Kameoka et al.

[11] Patent Number: 5,424,702

[45] Date of Patent: Jun. 13, 1995

[54] SUPERCONDUCTING MAGNET

[75] Inventors: Yoko Kameoka; Hideshi Fukumoto, both of Hitachi; Ken Yoshioka, Hitachioota; Teruhiro Takizawa, Hitachi; Tadasi Sonobe, Iwaki; Fumio Suzuki, Hitachi, all of Japan

[73] Assignee: Hitachi, Ltd., Tokyo, Japan

[21] Appl. No.: 335,968

[22] Filed: Nov. 3, 1994

Related U.S. Application Data

[63] Continuation of Ser. No. 947,400, Sep. 21, 1992, abandoned.

[30] Foreign Application Priority Data

Sep. 19, 1991 [JP] Japan ..... 3-239900

[51] Int. Cl.[6] ..... H01F 1/00; H01F 5/00; H01F 7/06; F25B 19/00

[52] U.S. Cl. ..... 335/216; 335/300; 336/DIG. 1; 505/705; 505/879; 62/51.1

[58] Field of Search ..... 335/216, 300, 301; 505/705, 879; 336/DIG. 1; 62/51.1, 51.2

[56] References Cited

U.S. PATENT DOCUMENTS

| | | | |
|---|---|---|---|
| 3,360,692 | 12/1967 | Kafka | 317/123 |
| 4,300,360 | 11/1981 | Chanin | 62/514 R |
| 4,640,005 | 2/1987 | Mine | 29/599 |
| 4,833,434 | 5/1989 | Takechi | 335/217 |
| 5,019,247 | 5/1991 | Purcell | 209/224 |
| 5,065,583 | 11/1991 | Sasaki | 62/51.3 |

FOREIGN PATENT DOCUMENTS

| | | | |
|---|---|---|---|
| 57-48202 | 3/1982 | Japan | 335/216 |
| 60-217610 | 10/1985 | Japan . | |
| 167285 | 2/1987 | Japan | 335/216 |
| 62-165901 | 7/1987 | Japan . | |
| 165901 | 7/1987 | Japan | 335/216 |
| 183503 | 8/1987 | Japan | 335/216 |
| 187606 | 8/1988 | Japan | 335/216 |
| 0174708 | 3/1989 | Japan | 335/216 |
| 1115107 | 5/1989 | Japan | 335/216 |
| 1115107 | 5/1989 | Japan . | |
| 2246201 | 10/1990 | Japan | 335/216 |
| 325808 | 2/1991 | Japan | 335/216 |
| 352203 | 3/1991 | Japan . | |

*Primary Examiner*—Gerald P. Tolin
*Assistant Examiner*—Stephen T. Ryan
*Attorney, Agent, or Firm*—Antonelli, Terry, Stout & Kraus

[57] ABSTRACT

A beam member which is installed at diametral portion in a ring shape superconducting coil container for supporting hoop stress of the coil, or a portion of radiant heat shield covering the beam member, is partly or entirely composed of electrical insulators or high resistivity materials. In accordance with the above composition, eddy current which is generated in the coil container when the superconducting coil container crosses magnetic field caused by eddy current which is generated in the radiant heat shield when the radiant heat shield crosses strong magnetic field caused by the superconducting coils with relative vibration of the radiant heat shield to the superconducting coil by a dynamic cause can be suppressed. Accordingly, heat generation in the superconducting coil container can be reduced, and consequently, generation of quenching can be prevented.

33 Claims, 8 Drawing Sheets

SUPERCONDUCTING MAGNET

This appliation is a continuation of Ser. No. 07/947,400, filed Sep. 21, 1992, now abandoned.

BACKGROUND OF THE INVENTION (1) Field of the Invention

The present invention relates to a superconducting magnet which uses a container having a diametrically crossing beam member which supports a coil container containing a superconducting coil and, especially to a preferable superconducting magnet for avoiding quenching by reducing heat generation which is caused by the beam member installed in a dynamic environment.

(2) Background of the Invention

A schematic perspective cross section of a superconducting magnet having a beam member with a coil container is indicated in FIG. 2. The numeral 1 is a superconducting coil, 2 is a ring-shape superconducting coil container which contains such a coolant as liquid helium and the superconducting coil 1, 3 is a beam member crossing a diametrical portion of the superconducting coil container 2, 4 is a radiant heat shield for protecting the container 2 from entering the radiant heat by covering an outer surface of the container 2, 5 is a vacuum adiabatic vessel, and 6 is a supporting member for fixing the superconducting coil vessel 2 to the vacuum adiabatic vessel 5. Generally speaking, as materials for the superconducting coil container 2, such materials as stainless steel (hereinafter shortly called SUS) having high stiffness and strength, etc., are used in order to support hoop stress of the superconducting coil 1. Similarly, SUS is used as material for the beam member 3 and the supporting member 6 both of which support electromagnetic force and heavy weight. On the other hand, as materials for the radiant heat shield 4, aluminum which has high radiation reflectance, light weight, and large thermal conductivity etc. are generally used. As materials for the vacuum adiabatic vessel 5, SUS and other thick wall materials are generally used in order to maintain inside of the vessel vacuum for protection from inflow of external heat and to support the superconducting coil etc.

Superconducting magnet causes quenching when temperature of superconducting wiring material composing the superconducting coil 1 is elevated higher than the critical temperature of the material, and come to be unable to maintain the superconducting state. Accordingly, it is an important issue to maintain temperature of the superconducting coil 1 lower than the critical temperature, and to keep the superconducting state.

Hitherto, as for inflow of external heat, countermeasures using the above described radiant heat shield 4 and the vacuum adiabatic vessel 5 etc. have been taken for preventing radiation and heat transfer. Further, various countermeasures against inflow of external heat by conduction, for example, such a method by extending heat flow path as disclosed in JP-A-57-208111 (1982) have been taken.

The above described countermeasures for preventing inflow of external heat is premised on an assumption that the superconducting magnet is used in a static environment. Accordingly, any countermeasures are not considered on heat generation in an internal operation of the superconducting magnet itself when, for example, any external force is added to the superconducting magnet, or the superconducting magnet is used in a dynamic environment. One of sources which generates heat in the case when the superconducting magnet is used in a dynamic environment is eddy current which is generated in the superconducting coil container. A conventional superconducting magnet has a structure shown in FIG. 2 wherein the superconducting coil container 2 is directly fixed to the vacuum adiabatic vessel 5 with the supporting member 6, and the radiant heat shield 4 is fixed to the supporting member 6 which supports the superconducting coil container 2. Moreover, conventional radiant heat shields are generally made of aluminum, and have a structure which easily causes relative vibration to the superconducting coil 1 because of thinness and light weight. Therefore, when vibration is transmitted inside from outside, relative vibration between the superconducting$_G$ coil and the radiant heat shield is caused, and the radiant heat shield 4 comes to be crossing a strong magnetic field which is yielded by the superconducting coil 1. Accordingly, eddy current is induced in plate members of the radiant heat shield 4, further eddy current is induced in the superconducting coil container 2 by crossing over the superconducting coil container 2 by magnetic field induced by the above described eddy current, and, consequently, the eddy current becomes a cause of heat generation and causes a problem to make the superconducting coil become quenched.

As for the above described problem, a countermeasure to suppress the heat Generation by adhering low resistant material such as aluminum, etc., on the superconducting coil container 2 in order to flow the eddy current through the low resistant material even if the eddy current is caused as disclosed in JP-A-60-217610 (1985).

But, hitherto, investigation whether the above described disclosure effects on heat Generation of the beam member 3 which is fixed to the superconducting container 2 or not, and if the effect may exist, how much does it effect on the heat Generation of the beam member 3 has not been performed, and, consequently, none of countermeasures for heat Generation of the beam member 3 is considered.

SUMMARY OF THE PRESENT INVENTION (1) Objects of the Invention

The object of the present invention is to provide a superconducting magnet wherein heat generation in a superconducting coil container having a beam member is so reduced that quenching of the superconducting magnet is scarcely caused even in a dynamic condition.

(2) Methods Solving the Problems

The above described object is realized in a superconducting magnet wherein a superconducting coil is contained in a coil container and a beam member for supporting the coil is crossed over at an inner diametral portion of the coil container by composing the beam member electric insulators, and composing a part of the beam member with electric insulators which prevent eddy current flow through a closed loop composed of the beam member and the coil container.

The above described object is also realized by composing the beam member with high resistant materials, and composing a part of the beam member with high resistant materials which reduce eddy current flow through a closed loop composed of the beam member and the coil container.

The above described object is also realized by composing the coil container with electric insulators or high resistant materials which interrupt or reduce circulation of electric current in a circumferential direction by placing the insulators or the materials at predetermined positions in a circumference of the coil container.

The above described object is also realized by discontinuous adhering of electric conductors or low resistant materials on an exterior wall surface of the coil container.

The above described object is also realized by composing a part of a radiant heat shield covering exterior surface of the coil container, which covers a whole portion of the beam member, with electric insulators or high resistant materials.

The above described object is also realized by inserting a high resistant region which interrupt or reduce eddy current flow through a radiant heat shield covering a closed loop which is composed of the beam member and the coil container in the radiant heat shield covering exterior surface of the coil container into a part of the radiant heat shield covering the beam member.

The above described object is also realized by placing the beam member at such a position that eddy current does not flow through a closed loop which is composed of the beam member and the coil container.

The above described object is also realized by discontinuous adhering of electric conductors or low resistant materials on an exterior surface of the beam member.

By composing a whole or a part of the beam member with insulators or high resistant materials, eddy current flow through a semicircular closed loop which is composed of the beam member and the coil container is interrupted or reduced and, consequently, heat generation by the eddy current is suppressed and a danger to cause quenching can be avoided.

Further, eddy current flow through the radiant heat shield, which is a source of eddy current flow through the coil container, is interrupted or reduced by composing a whole or a part of the radiant heat shield covering the beam member with insulators or high resistant materials, and, consequently, eddy current flow through the coil container is suppressed and heat generation at the coil container is reduced.

DETAILED DESCRIPTION OF THE PREFERRED EMBODIMENTS OF THE INVENTION

Hereinafter, an embodiment of the present invention is explained referring to the Figures.

First, theory of the present invention is explained.

Figure 2:
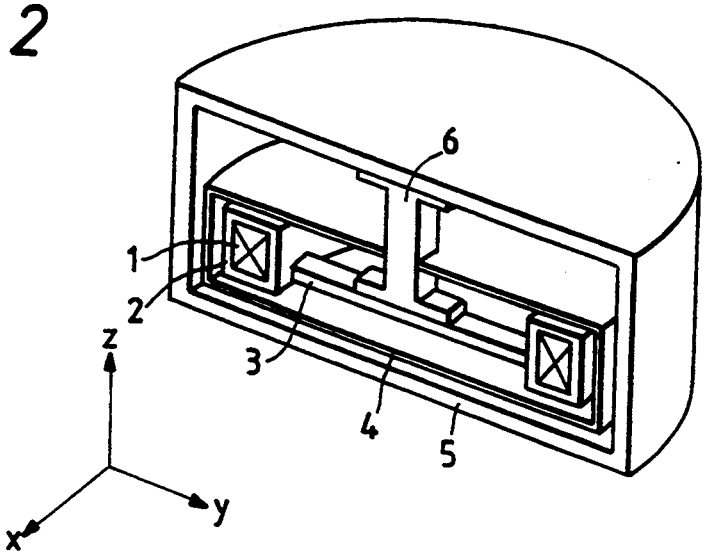
FIG. 2 is a schematic perspective cross section of a superconducting magnet being furnished with a beam member relying to an embodiment of the application of the present invention.
Figure 3:
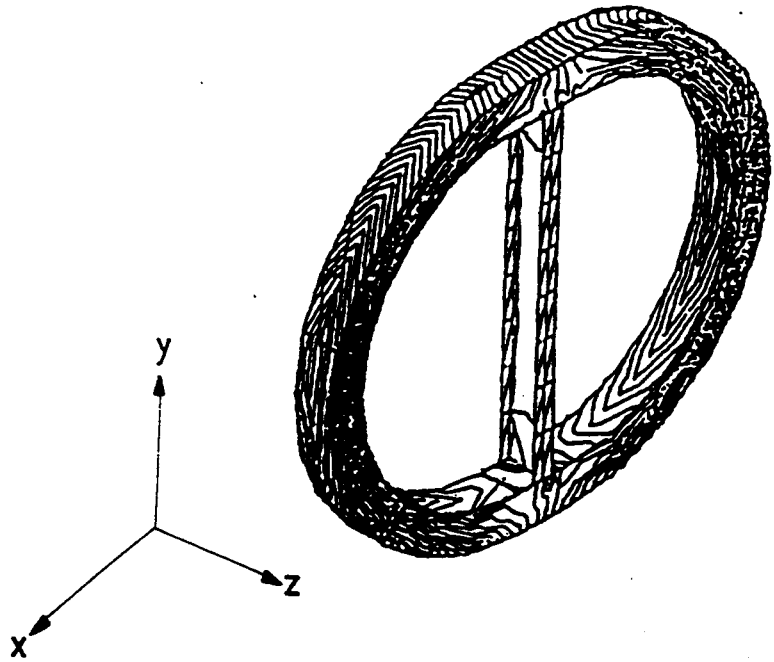
FIG. 3 is a drawing of an eddy current flow path formed by rotation around a Y-axis (corresponding to the time A in FIG. 5), obtained by three dimensional analysis, and drawn by a computer.
Figure 4:
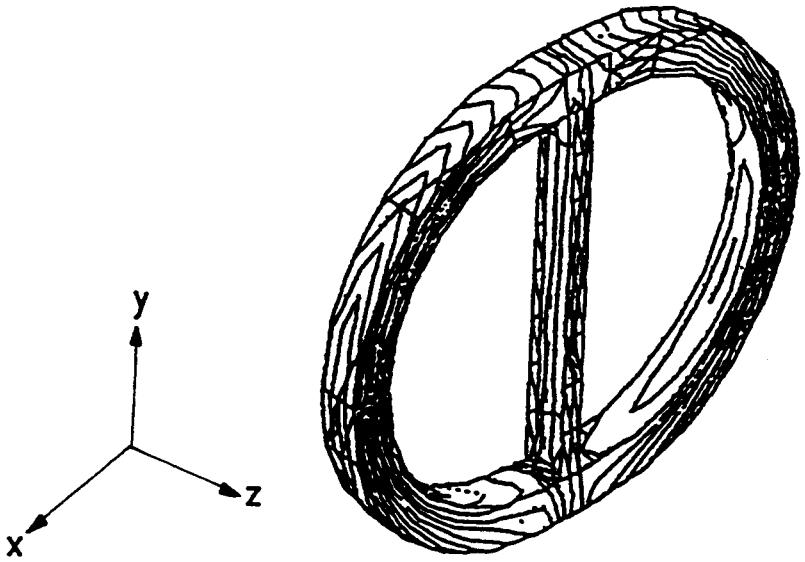
FIG. 4 is a drawing of an eddy current flow path formed by rotation around a Y-axis (corresponding to the time B in FIG. 5), obtained by three dimensional analysis, and drawn by a computer.
Figure 5:
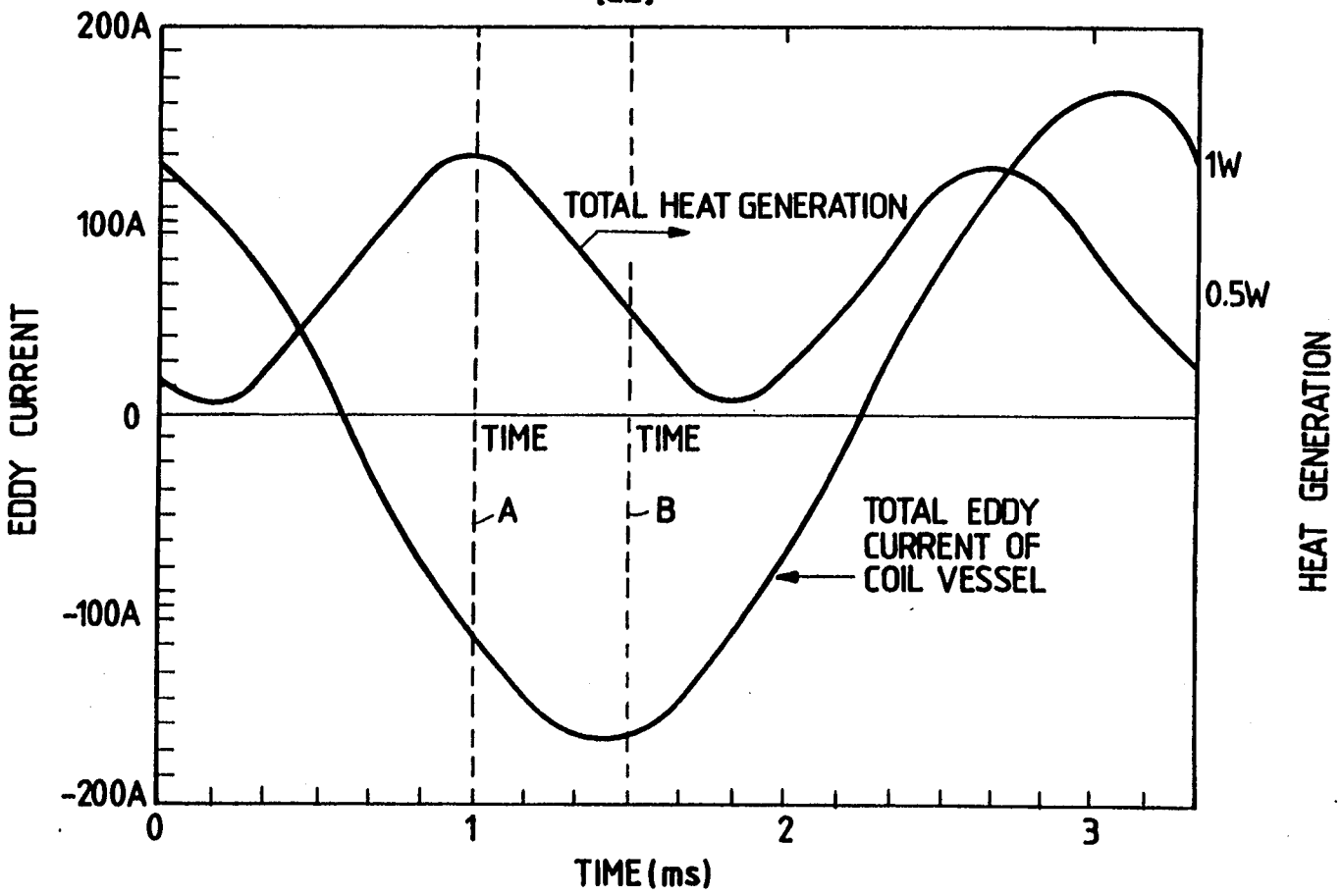
FIG. 5 is a graph indicating time dependent change of eddy current and heat generation obtained by three dimensional eddy current analysis.

As a result of three dimensional eddy current analysis by the inventors on such pure relative vibrations as rotation around X-axis, rotation around Y-axis, and rotation around Z-axis respectively of a radiant heat shield in a structure including a beam member, it was revealed that loop current was generated in a closed loop which was composed of a superconducting coil container and the beam member depending on installed positions of the beam member, and that heat generation of the beam member at the time became dominant in heat generation of the superconducting coil container and, consequently, the heat generation of the beam member could be main cause of quenching of the superconducting magnet. In the analysis, a semicircular portion and the beam member were assumed to be respectively made from aluminum (low resistant material) and stainless steel (high resistant material). That means, materials having different resistance were used. For example, to the rotation of the radiant heat shield illustrated in FIG. 2 around Y-axis, there can be a case wherein such eddy current flow path as illustrated in FIG. 3 can be generated in an external surface of the superconducting coil container 2, or another case wherein such eddy current flow path as illustrated in FIG. 4 can be generated. Further, such complex behavior was revealed in that each of eddy current flowed through each of the above described eddy current flow paths was exchanged alternately depending on phase of the vibration transmitted to the superconducting apparatus as indicated in FIG. 5, and that total eddy current became maximum when eddy current in the beam member was not generated, but, heat generation in the superconducting coil container became maximum when eddy current flowed in the beam member as illustrated in FIG. 4 although total eddy current was less than the maximum value.

The above described three dimensional eddy current analysis was performed by dividing a governing equation to eddy current J (r, t) in a conductor by an finite element method and subsequent numerical simulation. It was confirmed that a result of the simulation on a similar system as FIG. 2 fairly coincided with experimental values.

$$\eta J + \frac{d}{dt} \frac{\mu_0}{4\pi} \int \frac{J(r')}{|r - r'|} dr' = 0$$

Where, $\eta$ is resistivity of the conductor, $\mu$ is vacuum permeability, and r is spatial coordinates. The above governing equation means that voltage difference (first term) by the conductor resistance and electromagnetic induction electromotive force by time-dependant change of eddy current (second term) are balanced. Heat generation W is evaluated from the obtained eddy current J by the following equation;

$$W = \int \eta J^2 dr$$

The simplest and certain measure for suppressing heat generation in a beam member which is caused by eddy current flowed in the beam member in a superconducting coil container is composing the beam member in the coil container with electric insulators. According to the above described measure, eddy current flow through a closed loop composed of the coil container and the beam member is interrupted and heat generation is prevented. Consequently, a superconducting magnet which can hardly be quenched can be obtained.

Depending on structure of the beam member, there are some superconducting magnets wherein the beam member can not be composed with electric insulators because of insufficient strength. In this case, alternates are necessary. In accordance with the previously described three dimensional eddy current analysis, it was revealed that eddy current in the beam member could be suppressed by providing an insulating portion to a part of the radiant heat shield covering the beam member of the superconducting coil container. Electric coupling between the coil container and the radiant heat shield causes induction of eddy current from the radiant heat shield to the coil container. Accordingly, eddy current flow in the beam member of the coil container can be indirectly suppressed by interrupting eddy current flow in the part of the radiant heat shield covering the beam member. In accordance with the above described procedure, eddy current flow in the beam member is suppressed and heat generation is reduced and, consequently, total heat generation in the whole superconducting coil container is reduced, and the superconducting magnet which can be hardly quenched is obtained.

The above described method is effective even in an occasion wherein providing an insulating portion directly to the beam member of the coil container is impossible on account of supporting strength of electromagnetic force or any of other reason.

In an occasion wherein providing a complete insulating portion to the beam member is impossible on account of manufacturing procedure, a high resistant portion is provided for taking the place of the complete insulating portion. In accordance with the above described procedure, eddy current which flows as a closed loop current through the beam member can be suppressed. In the above described occasion, if vibration frequency due to external disturbance, namely frequency region of the eddy current, is in a resistive region (low frequency), it is possible to eliminate heat generation at the beam member by interrupting electric current with a high resistant portion, or even in an occasion wherein the electric current is not completely interrupted, insertion of a high resistant portion can suppress the eddy current by increasing resistance against a circulation current and reduce the heat generation as a whole.

Figure 13:
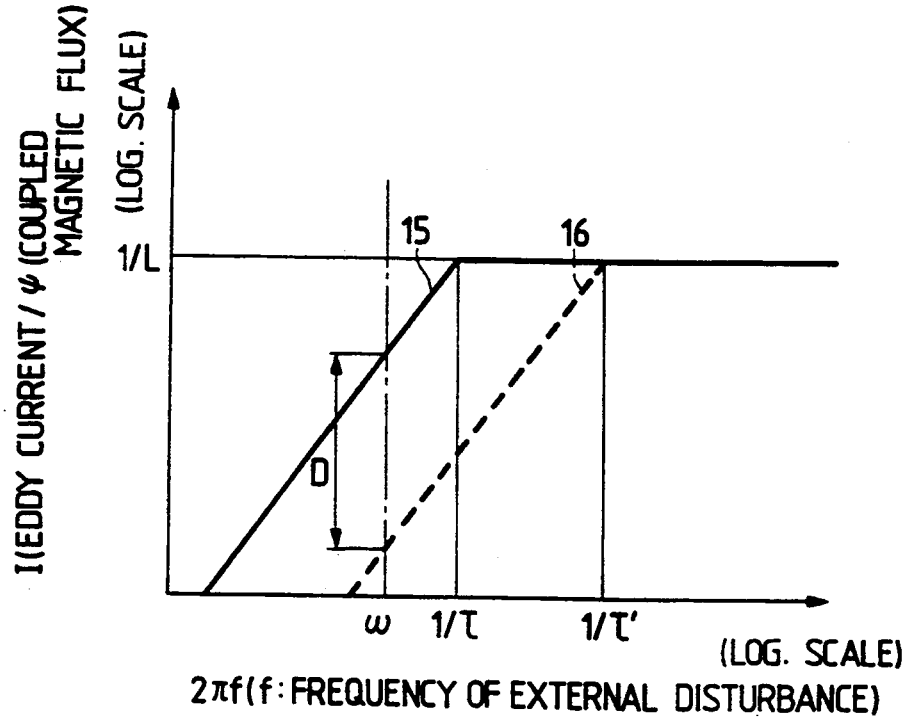
FIG. 13 is a graph indicating a relation between frequency of external disturbance and eddy current caused by the external disturbance.

Referring to FIG. 13, the resistive region is explained hereinafter. In FIG. 13, vibration frequency added to the magnet is taken on the abscissa and a value of eddy current flow divided by coupled magnetic flux is indicated on the ordinate in logarithm scale. The resistive region is the frequency region less than $1/\tau$ of the broken solid line ($\tau = L/R$, L: equivalent inductance to the eddy current flow path, R: equivalent resistance to the eddy current flow path), and the eddy current has a tendency to increase in proportion to the frequency. In the resistive region, heat generation is proportional to 1/R, and heat generation is reduced as the resistance R is increased. That means, as the resistance increases, the solid line moves from the position of the solid line 15 to the chain line 16, eddy current which is generated by a same vibration frequency $\omega$ due to external disturbance decreases by D in FIG. 13, and, further, the resistive region expands from $1/\tau$ to $1/\tau$ (where, $\tau' = L/(R+R')$). But, in the inductive region (high frequency), namely a frequency region of higher than $1/\tau$, the eddy current flow becomes constant independent to the resistance as indicated by the solid line 15 and the chain line 16 in FIG. 13, and accordingly heat generation is increased in proportion to the resistance R. Therefore, when insertion of high resistance is performed, it is necessary to set the vibration frequency due to external disturbance in the resistive region. By the above described procedure, heat generation in the beam member is suppressed and heat generation in the whole coil container is reduced, and consequently quenching is prevented.

Similarly, by providing a high resistant portion to the part of radiant heat shield covering the beam member, the part of the radiant heat shield can be difficult in eddy current flow, and eddy current in the part of the radiant heat shield which is induced by electric coupling of the superconducting coil container and the radiant heat shield can be suppressed. In this occasion, eddy current flow in the radiant heat shield behaves as same as the above described eddy current, and if the vibration frequency due to external disturbance is set in the resistive region, the eddy current does not flow, or becomes very small. In any way, the eddy current flowing through the beam member in the coil container can be suppressed by the electric coupling, and heat generation in the beam member can be reduced. Accordingly, heat generation in the whole coil container is reduced, and a superconducting magnet which can hardly be quenched can be obtained.

Figure 6:
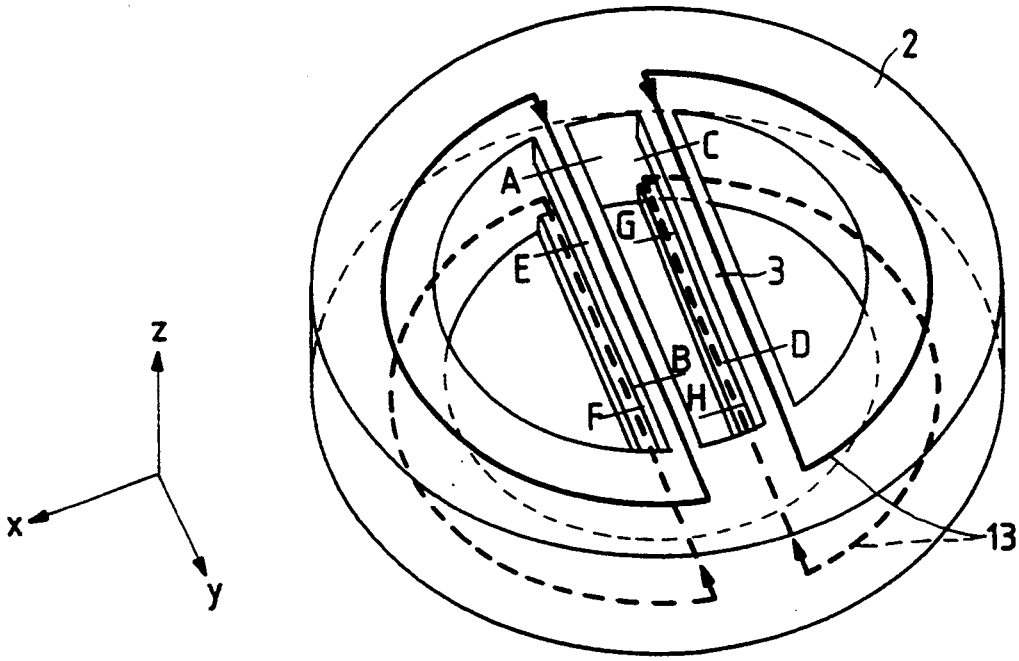
FIG. 6 is a perspective view indicating an example of eddy current path formed by rotation around a Y-axis.
Figure 7:
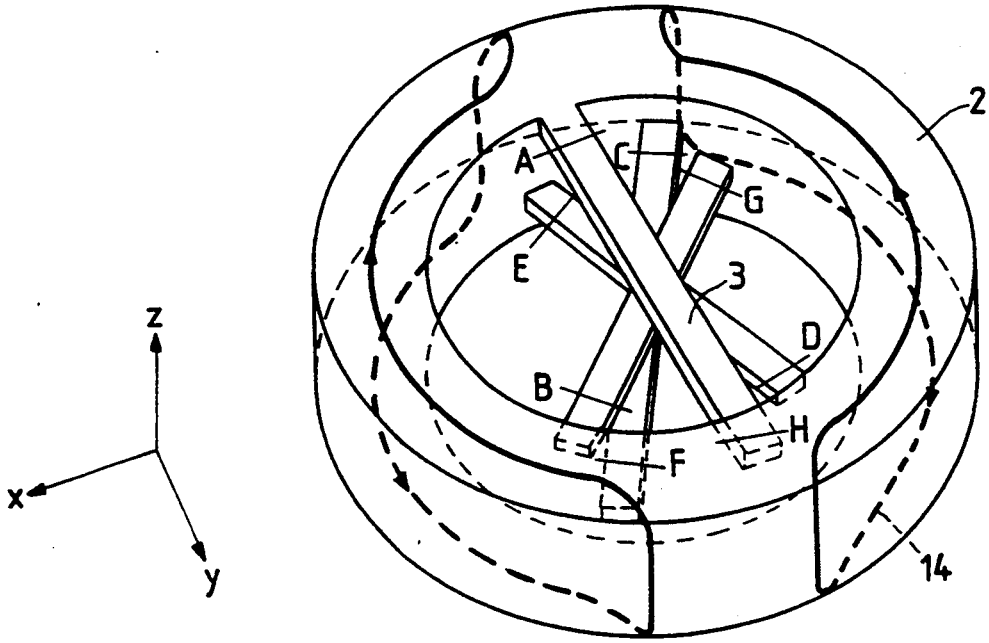
FIG. 7 is a perspective view of a superconducting coil container relating to another embodiment of the present invention.

Further, because the three dimensional eddy current analysis revealed that a beam member in a conventional coil container was arranged in a position which made the beam member easy to flow circulating electric current through the beam member, the fixed position of the beam member in the coil container was changed to a position where the circulating electric current does not flow in order not to flow the eddy current in the beam member and to suppress heat generation in the beam member. That means, the beam member may not be arranged in the eddy current path. For example, the eddy current loop illustrated in FIG. 6 which is caused by rotational vibration around the Y axis of the radiant heat shield becomes one turn current as illustrated in FIG. 7 if the beam member does not locate at the position and the superconducting coil container is a simple circular shape. That means, if the beam member is located in a position where eddy current easily flows, the eddy current forms a current path by flowing the beam member. And, the eddy current flow through the beam member can be suppressed by installing the beam member at a position where it is not the current path of the eddy current, or at a position where current path portions of eddy counter each other are connected as illustrated in FIG. 7. Consequently, heat generation by the eddy current at the beam member can be reduced, total heat generation of the coil container itself is reduced, and the superconducting magnet which can hardly be quenched can be obtained.

The heat generation can also be reduced by adhering, evaporation deposition, or plating low resistant materials such as aluminum, copper, silver, and gold etc., of which electrical resistivity decrease remarkably at liquid helium temperature (4° K.), on a surface of the beam member in order to flow electric current through the low resistant materials when eddy current is caused. In accordance with the three dimensional eddy current analysis, heat generation at the beam member can be reduced to 1/5–1/10 of the prior art by performing the above described countermeasures, as described later in detail.

In the explanation on installing the high resistant portion at the beam member, the inductive region has been explained. The adhering, etc., of the low resistant materials are especially effective to the superconducting magnet which is used in the inductive region, in other words, to the superconducting magnet which can not increase $1/\tau$ larger than the maximum value $\omega$ of the vibration frequency of external disturbance. In the inductive region, it is clearly understood that heat generation is proportional to the resistant value because electric current has a constant value and, consequently, heat generation can be reduced depending on reduction of the resistant value. Accordingly, the superconducting magnet which can hardly be quenched can also be obtained by the above described methods. Especially, it becomes more advantageous when materials having high purity more than 99.9% are used as the low resistivity materials, because the resistivity of the materials at liquid helium temperature (4° K.) decrease to 1/10–1/100 of the resistivity at room temperature and heat generation can farther be reduced that much.

(Embodiment 1)

Next, data obtained by the three dimensional eddy current analysis and an embodiment of a superconducting magnet manufactured depending on the result of the analysis are explained in detail.

Figure 1:
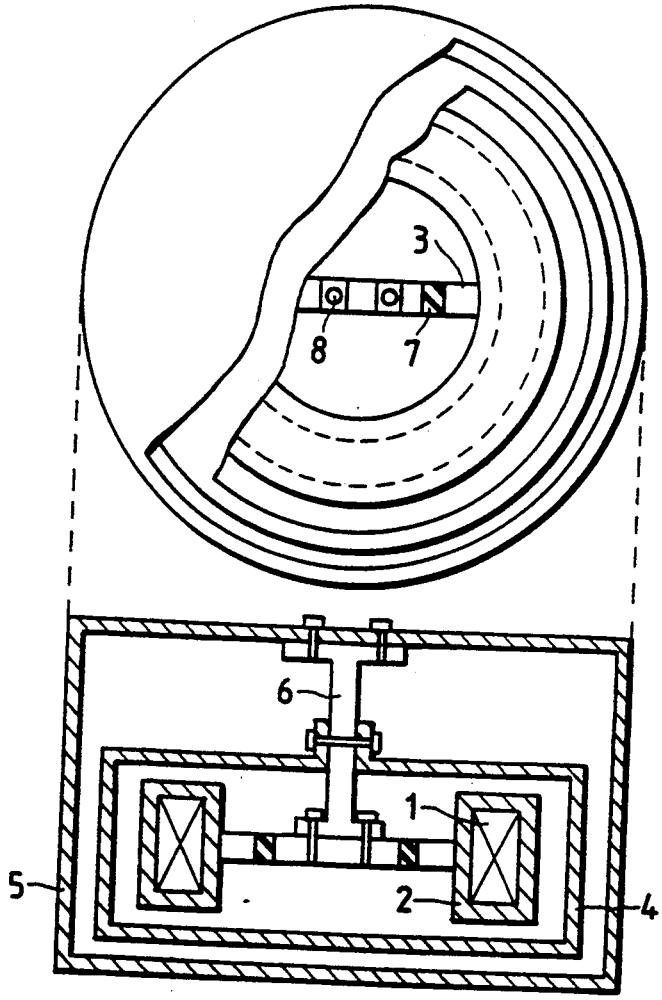
FIG. 1 is a combination of a plan view and a cross section of a superconducting magnet relating to an embodiment of the present invention.

FIG. 1 is a plan view and a cross section of a superconducting magnet relating to the first embodiment of the present invention. The superconducting coil 1 is contained in the ring-shape superconducting coil container 2 with coolant of liquid helium. The superconducting coil container 2 is made from stainless steel in order to support the superconducting coil 1 and electromagnetic force such as hoop stress caused in the superconducting coil 1 as well. Otherwise, as disclosed in JP-A-60-217610 (1985), almost an entire external surface of the container made from SUS is discontinuously coated with aluminum in order to reduce heat generation of the container 2 itself. The numeral 3 indicates the beam across the superconducting coil container in a diametral direction. The beam 3 is made from SUS and fixed to the superconducting coil container 2 by welding, and is cooled down to the liquid helium temperature as well as the superconducting coil container 2. The superconducting coil container 2 is fixed to the vacuum adiabatic vessel 5 with the supporting member 6 as the beam 3 is used as a supporting portion. The radiant heat shield 4 is placed between the vacuum adiabatic vessel 5 and the superconducting coil container 2 in order to interrupt entering of radiant heat to internal coil container 2 side, and is made from aluminum and cooled down to 80° K. with liquid nitrogen. A part of the beam 3 made from SUS in the present embodiment is interrupted, and the electric insulating portion 7 is provided. Detail of the insulating portion 7 will be explained later in detail referring to FIG. 11. The numeral 8 indicates bolts fixing the beam 3 and the supporting member 6, or the supporting member 6 and the vacuum adiabatic vessel 5.

When the radiant heat shield 4 vibrates relatively to the superconducting coil 1 depending on external dynamic cause, the radiant heat shield 4 crosses strong magnetic field generated by the superconducting coil 1, and eddy current is generated in the radiant heat shield 4. The eddy current in the radiant heat shield 4 generates magnetic field, and crossing over the generated magnetic field by the superconducting coil container 2 causes eddy current in the superconducting coil container 2. But, the eddy current is interrupted by the insulating portion 7 which is provided at a part of the beam 3 and the eddy current is not flowed to the beam 3. Consequently, heat is not generated. In accordance with the present embodiment, generation of quenching is prevented because heat generation in the superconducting coil container 2 is suppressed to less than the conventional example illustrated in FIG. 2 in which eddy current flows in the beam 3.

In the present embodiment, heat generation reducing effect is quantitatively determined by the three dimensional eddy current analysis. FIGS. 3 and 4 are eddy current flow patterns obtained by the three dimensional eddy current analysis as previously described and drawn by a computer. The coil model used in the analysis was rather a little bit elliptical shape than an exact circle as indicated in FIG. 1. Major axis of the coil model was about 1000 mm. The calculation was performed under an assumption that the superconducting coil was excited to 500 KAT and relatively vibrated to the radiant heat shield around the Y-axis with $4\times10^{-8}$ rad, 300 Hz. The result of eddy current distribution calculation by a computer is illustrated in FIGS. 3 and 4. The lines in the Figures are equivalent to the current lines. The result was calculated on a case in which insulation is not provided to the beam 3, and the heat generation by eddy current was 1 W. The superconducting coil container 2 itself was coated with aluminum and heat generation was as small as 0.1 W, and major heat source was the beam 3. The generated heat of 1 W looks small, but it is a fairly large amount of heat in comparing with the quantity of liquid helium to maintain a temperature of the superconducting coil at 4° K., and a margin to quenching is remarkably reduced. The same three dimensional eddy current analysis was performed on a case in which the beam 3 was a perfect insulated body.

The heat generation in the beam 3 was naturally 0 W because the eddy current was completely interrupted, and heat generation in the coil container 2 itself was 0.1 W as same as the previous case, accordingly, total heat generation of the coil container was determined to be reduced to 1/10 by providing an insulation to the beam.

(Embodiment 2)

Figure 8:
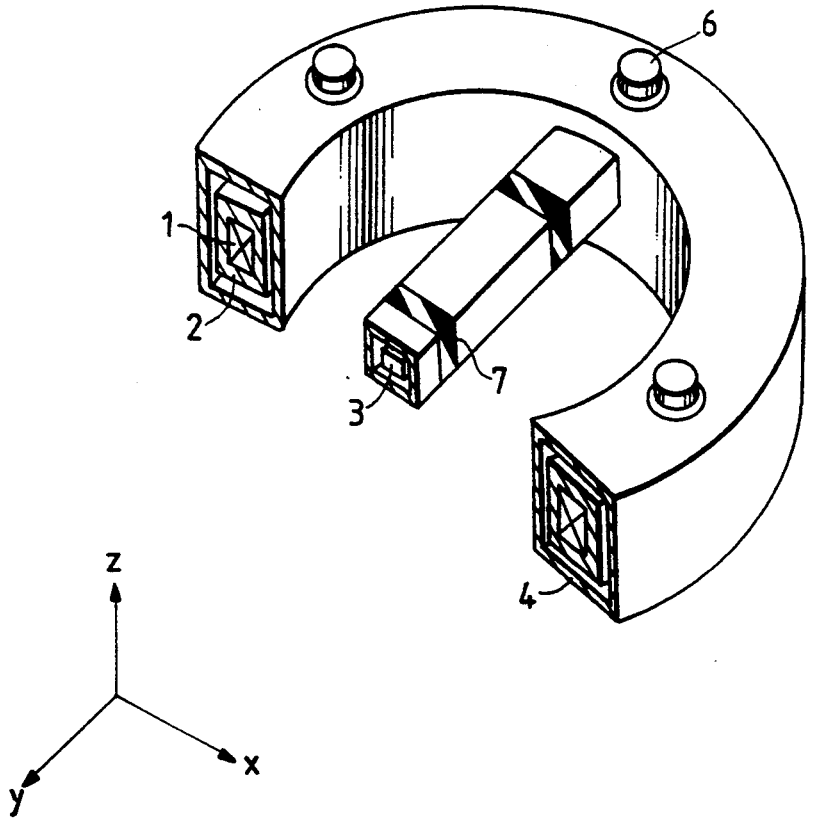
FIG. 8 is a partially sectional perspective view of a radiant heat shield relating to another embodiment of the present invention.
Figure 12:
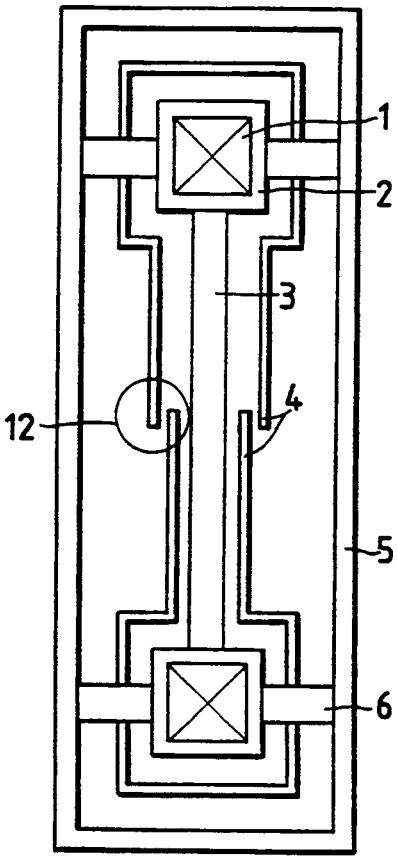
FIG. 12 is an illustration indicating a structure in an embodiment of insulators fixed to a radiant heat shield.

FIG. 8 is a partial perspective cross section of a superconducting magnet relating to the second embodiment of the present invention. The composition of the superconducting magnet relating to the present embodiment is fundamentally same as that of the first embodiment except shape of the radiant heat shield. The radiant heat shield 4 in the first embodiment was a simple circular shape, but shape of the radiant heat shield 4 in the present embodiment was completely along the shapes of the superconducting coil container 2 and the beam 3, and the radiant heat shield 4 was composed so as to cover the beam 3 itself. And, the insulating portion 7 is provided to a part of the radiant heat shield covering the beam 3 in the present embodiment. When an external dynamic effect causes relative vibration of the radiant heat shield 4 to the superconducting coil 1 and the radiant heat shield 4 crosses magnetic field generated by the superconducting coil 1, eddy current is generated in the radiant heat shield 4, but the eddy current does not flow to the radiant heat shield covering the beam 3 because of interruption of the eddy current by the insulating portion 7. Consequently, eddy current to be generated in the beam 3 by electric coupling between the superconducting coil container 2 and the radiant heat shield 4 is also suppressed. Accordingly, heat generation in the beam 3 is also suppressed and total heat generation in the superconducting coil container is reduced, and the superconducting magnet can hardly be quenched can be obtained. The details of the insulating portion 7 is illustrated in FIG. 12 as a portion indicated by the numeral 12, and will be explained later.

Similarly, the three dimensional eddy current analysis was performed on the second embodiment under an assumption that vibration condition and dimensions of the whole coil, etc., were same as the first embodiment. In the present case, total heat generation is 0.15 W. In the present embodiment, any insulating portion is not provided to the beam 3 and, consequently, small amount of eddy current flows in the beam 3. Heat generation of 0.05 W in the beam 3 and 0.1 W in the coil container 2 makes total heat generation of 0.15 W. As above explained, it is revealed that the heat generation can be remarkably reduced to about 15% by insulation at only the radiant heat shield.

The present embodiment is preferable as an alternate method when the insulation of the beam is difficult on account of geometrical shape of the coil container 2 or in relation to make the structure of the coil container for supporting hoop stress from the coil.

(Embodiment 3)

Figure 9:
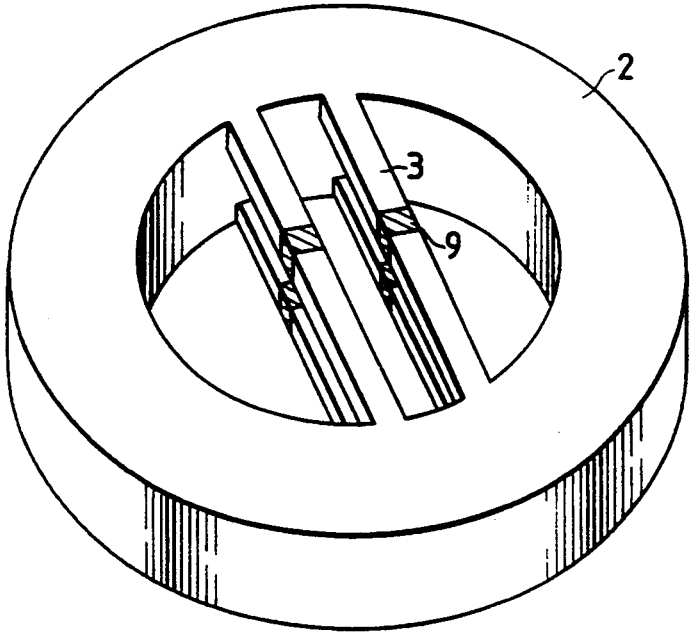
FIG. 9 is a perspective view of a superconducting coil container relating to another embodiment of the present invention.

The third embodiment of the present invention is illustrated in FIG. 9. Fundamental composition of the third embodiment is as same as that of the first embodiment, but a portion indicated by the numeral 9 in the present embodiment is not the insulating portion but the high resistant portion. When an external dynamic effect causes relative vibration of the radiant heat shield 4 to the superconducting coil 1, eddy current is generated in the radiant heat shield 4 by crossing over the magnetic field which is generated by the superconducting coil 1, and further eddy current is generated in the superconducting coil container 2 by crossing over the magnetic field which is generated by eddy current in the radiant heat shield 4, but the eddy current is interrupted by setting the vibration frequency of external disturbance in the resistive region with the high resistant portion 9 of the beam 3. Consequently, eddy current in the beam 3 is suppressed and heat generation is also suppressed. Even if eddy current flows through the high resistant portion 9, one turn resistance of a closed loop composed of a half of the container 2 and the beam 3 is increased by existence of the high resistant portion 9 and eddy current induced in the closed loop is reduced that much. Accordingly, if the resistant value of the high resistant portion is large enough, the heat generation is totally suppressed. Consequently, heat generation in the superconducting coil container 2 is suppressed and quenching becomes hard to occur.

Figure 15:
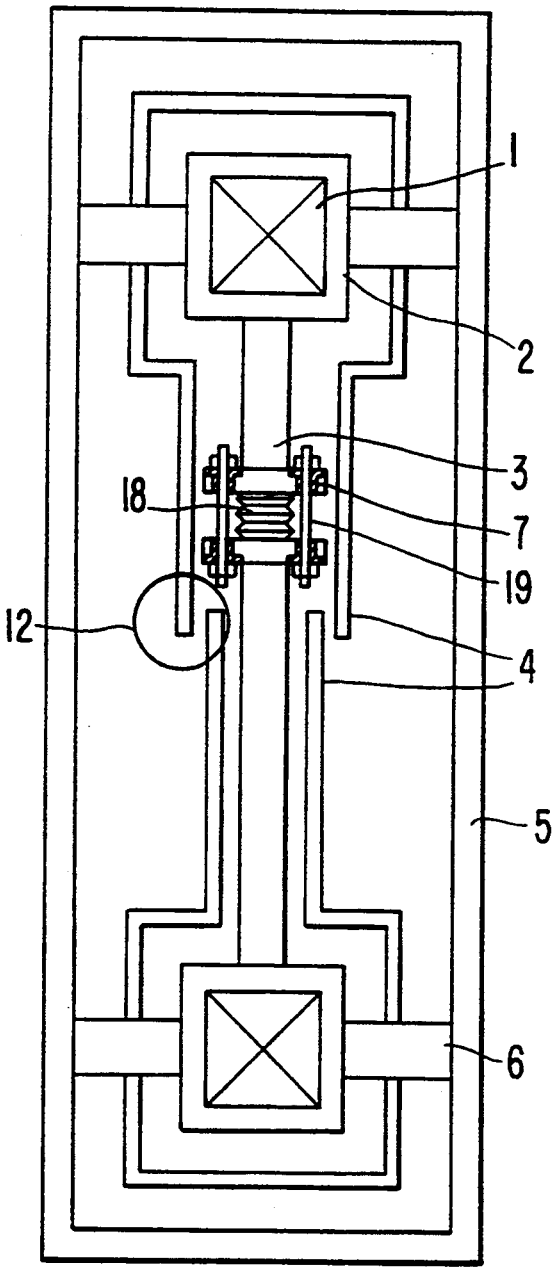
FIG. 15 is an illustration indicating a bellows structure in an embodiment of the invention.

Actually, the high resistant portion 9 is realized by such methods as being composed from high resistant materials such as inconel steel rather than stainless steel, or the total beam 3 itself is manufactured from stainless steel and make the high resistant portion have a bellow structure 18 as illustrated in FIG. 15, and including flanges 7 and bolds 19 in order to increase resistivity in a longitudinal direction.

(Embodiment 4)

Figure 10:
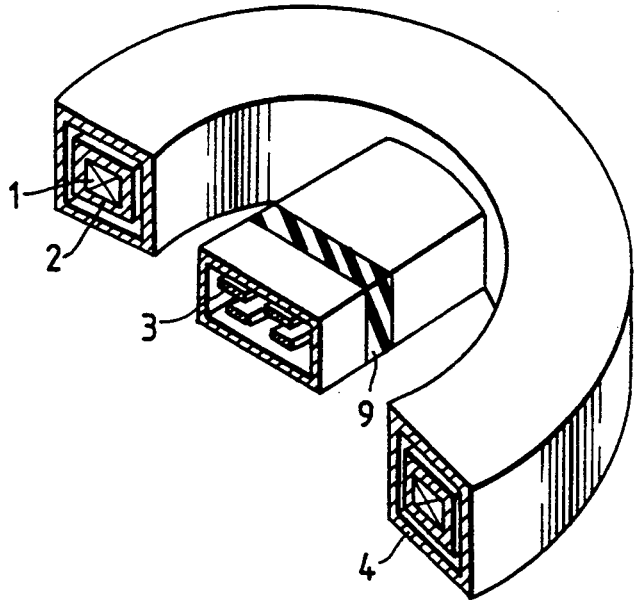
FIG. 10 is a partially sectional perspective view of a radiant heat shield covering the coil container illustrated in FIG. 9.

The fourth embodiment of the present invention is illustrated in FIG. 10. Fundamental composition of the fourth embodiment is as same as that of the first embodiment, but the radiant heat shield 4 of the fourth embodiment contains the superconducting coil container 2 having the shape illustrated in FIG. 9, and the high resistant portion 9 is provided at a part of the radiant heat shield 4 covering the total four beams of the superconducting coil container 2.

When the radiant heat shield 4 vibrates relatively to the superconducting coil 1 by an external dynamic effect and crosses over the magnetic field generated by the superconducting coil 1, eddy current is generated in the radiant heat shield 4 by crossing over the magnetic field which is generated. But, the eddy current is interrupted because the high resistant portion 9 provided at a part of the radiant heat shield covering the beam 3 makes vibration frequency of external disturbance set in the resistive region, and eddy current which is due to be flowed through the part of the radiant heat shield covering the beam 3 is not generated. Or, even if eddy current flows through the high resistant portion 9, the induced eddy current decreases that much corresponding to increment of one turn resistivity by addition of the high resistant portion 9. In any way, there is an electric coupling between the superconducting coil container 2 and the radiant heat shield 4, and if eddy current flowing through a part of the radiant heat shield 4 covering the beam 3 is suppressed, eddy current induced in the beam itself is also suppressed. Consequently, heat generation in the beam 3 is suppressed and total heat generation of the superconducting coil container is reduced, and a superconducting magnet which can hardly be quenched can be obtained.

(Embodiment 5)

The fifth embodiment of the present invention is illustrated in FIG. 7. The superconducting coil 1 is contained in the superconducting coil container 2 with a coolant, liquid helium. The superconducting coil container 2 is made from SUS in order to support the superconducting coil 1 and electromagnetic force such as hoop stress generated in the superconducting coil 1 at the same time. The numerical 3 indicates a beam of the superconducting coil container. The beam 3 is made from SUS and is fixed to the superconducting coil container 2 by welding, and is cooled to liquid helium temperature as same as the superconducting coil container 2. If assuming that an external rotatory vibration around a Y axis is added to the radiant heat shield 4 covering the superconducting coil container 2 as illustrated in FIG. 6, the current paths 13 of eddy currents in this case become as illustrated in FIG. 6 and each eddy currents of left side and right side, and also face side and back side, has a rotating direction reverse to each other. Therefore, the paths of the eddy currents due to flow in each of four semi-circular loops at left and right, and face and back, of the coil container 2 are changed by respectively changing the connection of the beam between A and B to A and H, the beam between C and D to C and F, the beam between E and F to E and D, and the beam between G and H to G and B as illustrated in FIG. 7 in order to make a current path in which only the turn current 14 flows ring body portion of the coil container 2. That means, circulating current is made to be interrupted between the superconducting coil container 2 and the beam 3. Consequently, the eddy current flowing through the beam 3 is suppressed and heat generation in the beam is reduced. Accordingly, total heat generation in the superconducting coil container itself is suppressed, and a superconducting magnet which is hardly be quenched can be obtained.

Next, the structure of the "insulating" portion described in the first and second embodiments are concretely explained.

Figure 11:
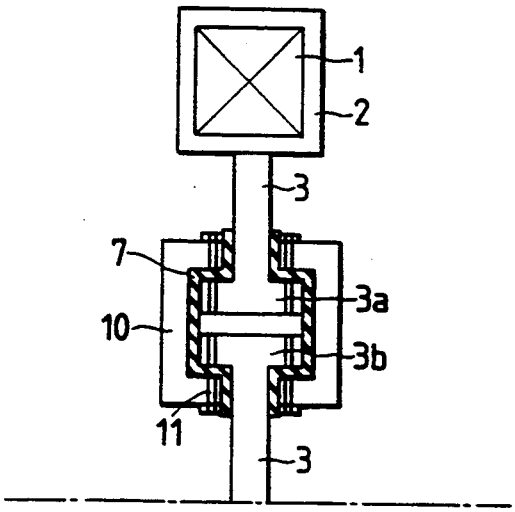
FIG. 11 is an illustration indicating a structure relating to an embodiment of insulators fixed to a beam member.

FIG. 11 is a cross section illustrating details of the insulating portion described in the first embodiment. The numeral 1 is a superconducting coil, 2 is a superconducting coil container, 3 is a beam made from SUS. The beam 3 is divided into two portions, and the end portions 3*a* and 3*b* are respectively formed in a flange shape having larger diameter. The end portions 3*a* and 3*b* are arranged facing each other, the fixing member 10 made from SUS which covers both of the end portions 3*a* and 3*b* together is attached to the end portions with the insulator 7 between so that the fixing member 10 and the end portions 3*a* and 3*b* are respectively electrically insulated, and the fixing member 10 and the end portions 3*a* and 3*b* are fixed together with insulated bolts 11. By forming the above described structure, even though a strong tensile stress caused by strong electromagnetic force is applied to the beam 3, the fixing member 10 bears the tensile stress and supports the superconducting coil container 2 thoroughly in addition to maintain the insulation. As materials for the insulator 7, fiber reinforced plastics, ceramics such as alumina, etc., and low temperature resistant plastics such as kapton, and teflon (commercial name), etc., are used.

FIG. 12 is a cross section illustrating details of the insulator described in the second embodiment.

The numeral 1 is a superconducting coil, 2 is a superconducting coil container, 3 is a beam made from SUS, and 4 is a radiant heat shield. The radiant heat shield 4 has a discontinuous portion 12 at the portion covering the beam 3 and is insulated at the portion. The radiant heat shield 4 does not have many supporting points in order to avoid entering of the heat but is only fixed by simple structure, and large electromagnetic force is not applied except in a case of quenching. Accordingly, only providing a discontinuous portion at a part of the radiant heat shield 4 is sufficient without using a complex insulating structure such as combination of fiber reinforced plastics with the discontinuous portion. In a case when entering of the radiant heat should be extremely avoided, an overlapping structure in which one end of the discontinuous portion overlaps another end of the discontinuous portion is adopted.

(Embodiment 6)

Figure 14:
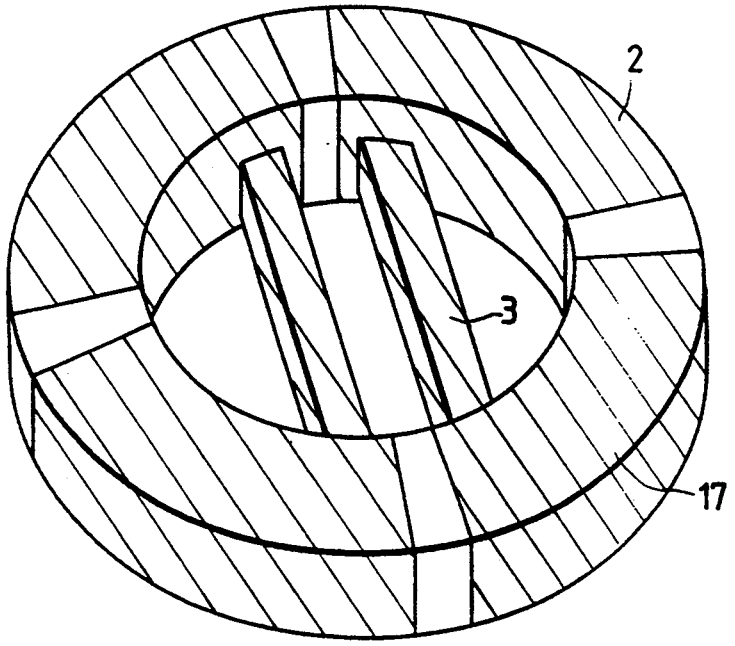
FIG. 14 is a perspective view of a superconducting coil container relating to another embodiment of the present invention.

The sixth embodiment of the present invention is illustrated in FIG. 14.

The numeral 2 is a superconducting coil container, and 3 is a beam owned by the superconducting coil container in both of which the hatched portions 17 are low resistant portions and others are bare portions of SUS part of the superconducting coil container. As for the low resistant materials, aluminum, copper, silver, and gold, etc., are used, and the material is attached to the beam and the coil container by any of means such as adhering, vapor depositing, welding, and plating, etc. In this case, heat generation is reduced by setting vibration frequency of external disturbance in an inductive region so as to decrease one turn resistance of the superconducting coil container 2. In addition to providing low resistant members to the superconducting coil container 2, the low resistant members are also attached to the beam 3, and total heat generation is decreased further. The reason not to cover a whole surface of the container with aluminum, etc., is to prevent an increasing of time and electric power required for starting up of the superconducting coil because the super conducting container 2 becomes easy to flow eddy current in excitation of the superconducting coil.

The three dimensional eddy current analysis being performed on the above described system under the same condition as the first embodiment revealed that total heat generation was 0.1 W and was reduced to 1/10 of the case in which low resistant materials were not provided to the beam 3. In accordance with the structure above described, heat generation in the superconducting coil container is reduced and a superconducting magnet which is hardly quenched can be obtained.

In addition to the beam structures in each of the above described embodiments, it is remarkably effective for reducing eddy current flow in the container itself by providing high resistant portions at a part of ring shape body of the coil container 2.

What is claimed is:

1. A superconducting magnet comprising:

a superconducting coil, a coil container made substantially of aluminum coated stainless steel, a beam member made substantially of stainless steel and being disposed across an inner diametral portion of said coil container for supporting said superconducting coil; and a suppressing means disposed along said beam member for suppressing eddy current flow through a closed loop including said beam member and said coil container.

2. A superconducting magnet as claimed in claim 1, wherein said suppressing means includes said beam member having a structure which substantially interrupts eddy current flow through the closed loop.

3. A superconducting magnet as claimed in claim 1, wherein said suppressing means includes said beam member being partially composed of a material which substantially interrupts eddy current flow through the closed loop.

4. A superconducting magnet as claimed in claim 1, wherein said suppressing means includes at least a portion of at least one of radiant heat shield which covers said beam member and said coil container being at least partly composed of a material which substantially interrupts eddy current flow through the closed loop.

5. A superconducting magnet as claimed in claim 1, wherein said suppressing means includes said beam member being at least partially composed of an electrical insulator.

6. A superconducting magnet as claimed in claim 5, wherein said electrical insulator is any one of fiberglass reinforced plastics, alumina, and carbon fiber glass reinforced plastics.

7. A superconducting magnet as claimed in claim 5, wherein said electrical insulator is a fluorine resin for an electrical insulator at low temperature.

8. A superconducting magnet as claimed in claim 1, wherein said suppressing means includes said beam member being at least partially composed of a high electric resistance material.

9. A superconducting magnet as claimed in claim 8, wherein said beam member is composed of inconel as said high electric resistance material.

10. A superconducting magnet as claimed in claim 8, wherein at least a part of said beam member is made highly electrically resistant by being composed of a bellow structure.

11. A superconducting magnet as claimed in claim 1, wherein said suppressing means includes said coil container being composed in such a manner that at least one of an electrical insulator material and a high electrical resistant material is arranged along a body of said coil container for cutting off or reducing circulation of eddy current along said body.

12. A superconducting magnet as claimed in claim 1, wherein. said suppressing means includes said coil container being composed in such a manner that an external surface of said coil container is coated discontinuously with aluminum.

13. A superconducting magnet as claimed in claim 4, wherein said portion of said radiant heat shield is entirely composed of at least one of an electric insulator material and a high electric resistant material.

14. A superconducting magnet as claimed in claim 13, wherein said radiant heat shield other than said portion is made from aluminum.

15. A superconducting magnet as claimed in claim 4, wherein said portion of said radiant heat shield is partly composed of a high resistivity region for interrupting or reducing eddy current which otherwise would flow through said radiant heat shield covering the closed loop.

16. A superconducting magnet as claimed in claim 15, wherein said radiant heat shield other than said portion is made from aluminum.

17. A superconducting magnet as claimed in claim 1, wherein said suppressing means includes said beam member being arranged at such a position that eddy current which flows through the closed loop is interrupted.

18. A superconducting magnet as claimed in claim 17, wherein said low resistivity material is any of aluminum, copper, gold, and silver.

19. A superconducting magnet comprising:

a superconducting coil, a coil container made substantially of aluminum coated stainless steel, and a beam member made substantially of stainless steel and being disposed across an inner diameteral portion of said coil container, wherein said beam member is at least partially composed of an electrical insulator for preventing eddy current flow through said beam member.

20. A superconducting magnet as claimed in claim 19, wherein said electrical insulator is any one of fiberglass reinforced plastics, alumina, and carbon fiberglass reinforced plastics.

21. A superconducting magnet comprising:

a superconducting coil, a coil container made substantially of aluminum coated stainless steel, and a beam member made substantially of stainless steel and being disposed across an inner diameteral portion of said coil container, wherein an electrical conduction path along said beam member is interrupted with an electrical insulator disposed along said beam member which prevents eddy current flowing through a closed loop being composed of said beam member and said coil container.

22. A superconducting magnet as claimed in claim 21, wherein said electrical insulator is fluorine resin for an insulator at low temperature.

23. A superconducting magnet comprising:

a superconducting coil, a coil container made substantially of aluminum coated stainless steel, and a beam member made substantially of stainless steel and being disposed across an inner diameteral portion of said coil container, wherein said beam member is at least partially composed of a high electric resistance material for reducing eddy current flow through said beam member.

24. A superconducting magnet as claimed in claim 23, wherein said beam member is partially composed of inconel as said high electric resistance material.

25. A superconducting magnet comprising:

a superconducting coil, a coil container made substantially of aluminum coated stainless steel, and a beam member made substantially of stainless steel and being disposed across an inner diameteral portion of said coil container, wherein said beam member contains areas composed of a high electric resistance material which reduces eddy current flowing through a closed loop being composed of said beam member and said coil container.

26. A superconducting magnet as claimed in claim 25, wherein a part of said beam member is made highly electrically resistant by being composed of a bellow structure.

27. A superconducting magnet as claimed in any of claims from claim 1 to claim 26, wherein said coil container is composed in such a manner that at least one of an electrical insulator material and a high electrical resistant material is arranged along a body of said coil container for cutting off or reducing circulation of eddy current along said body.

28. A superconducting magnet as claimed in any of claims from claim 19 claim 26, wherein said coil container is composed in such a manner that an external surface of said coil container except portions composed of said electrical insulator or high electrical resistance material is coated discontinuously with aluminum.

29. A superconducting magnet comprising:

a superconducting coil, a coil container made substantially of aluminum coated stainless steel, and a beam member made substantially of stainless steel and being disposed across an inner diameteral portion of said coil container, a radiant heat shield covering said beam member, wherein at least a portion of said radiant heat, shield covering said beam member is entirely composed of at least one of an electric insulating material and a high electrical resistant material.

30. A superconducting magnet comprising:

a superconducting coil, a coil container made substantially of aluminum coated stainless steel, and a beam member made substantially of stainless steel and being disposed across an inner diameteral portion of said coil container, a radiant heat shield covering said beam member, wherein a portion of said radiant heat shield coveting said beam member is partly composed of a high resistivity region for interrupting or reducing eddy current which flows through said radiant heat shield as part of a closed loop being composed of said beam member and said coil container.

31. A superconducting magnet as claimed in any one of claim 29 and claim 30, wherein said radiant heat shield is at least partially made from stainless steel or inconel.

32. A superconducting magnet comprising:

a superconducting coil, a coil container made substantially of aluminum coated stainless steel, and a beam member made substantially of stainless steel and being disposed across an inner diameteral portion of said coil container, wherein said beam member has a construction at a predetermined position such that eddy current which otherwise would flow through a closed loop being composed of said beam member and said coil container is interrupted.

33. A superconducting magnet comprising:

a superconducting coil, a coil container made substantially of aluminum coated stainless steel, and a beam member made substantially of stainless steel and being disposed across an inner diameteral portion of said coil container, wherein a surface of said beam member is coated with at least one of an electric conductor material and a low resistivity material for reducing eddy current flow through said beam member.

* * * * *